US005636442A

United States Patent [19]

Wain

[11] Patent Number: 5,636,442

[45] Date of Patent: Jun. 10, 1997

[54] SHAVING SYSTEMS WITH BLADE HOLDER

[75] Inventor: Kevin J. Wain, Berkshire, England

[73] Assignee: The Gillette Company, Boston, Mass.

[21] Appl. No.: 411,689

[22] Filed: Apr. 5, 1995

[30] Foreign Application Priority Data

Oct. 8, 1992 [GB] United Kingdom ..... 9221173

[51] Int. Cl.[6] ..... B26B 71/24

[52] U.S. Cl. ..... 30/40.2; 206/356; 206/359

[58] Field of Search ..... 30/40, 40.2; 206/356, 206/359

[56] References Cited

U.S. PATENT DOCUMENTS

| | | | |
|---|---|---|---|
| 3,834,018 | 9/1974 | Dawidowicz et al. | 206/359 X |
| 3,941,244 | 3/1976 | Braginetz . | |
| 4,043,035 | 8/1977 | Pentney | 30/40.2 |
| 4,090,638 | 5/1978 | Pentney . | |
| 4,173,285 | 11/1979 | Kiraly et al. . | |
| 4,492,024 | 1/1985 | Jacobson . | |

FOREIGN PATENT DOCUMENTS

| | | | |
|---|---|---|---|
| 0349870-A2 | 1/1990 | European Pat. Off. . | |
| 1160542 | 8/1969 | United Kingdom | 30/40.2 |
| WO90/11875 | 10/1990 | WIPO . | |

*Primary Examiner*—Douglas D. Watts
*Attorney, Agent, or Firm*—Edward S. Podszus; Donal B. Tobin

[57] ABSTRACT

A shaving system comprises novel components of a razor handle (1), a razor blade cartridge (2), and a magazine (5) holding a supply of cartridges. The handle and magazine are adapted to cooperate so that a used cartridge on the handle is replaced by (i) inserting the used cartridge into an empty magazine compartment, which unlatches the handle from the cartridge; (ii) moving the handle along the magazine towards a next adjacent compartment accommodating a fresh cartridge, firstly to disconnect the handle from the used cartridge which is left in its compartment and secondly to latch the handle onto the fresh cartridge held in the next compartment; and (iii) withdrawing from the magazine the handle with the fresh cartridge attached. Thus, the cartridges are dispensed from the magazine in turn with each cartridge replacement operation being effected by a single stroke of the handle relative to the magazine, this stroke having distinct components of insertion, advancement and withdrawal. A novel handle and cartridge coupling system is used, the cartridge having key elements (14) which engage in slots (15) provided on the handle so that the handle is connected to the cartridge by displacement relative thereto in a direction transverse to the cartridge and substantially parallel to its front face (25), and latch devices (18) which engage in notches (17) at the ends of the cartridge being provided on the handle to lock the cartridge against detachment from the handle. Conveniently, the latch devices and notches (17, 18) define a pivot enabling pivotal movement of the cartridge on the handle.

4 Claims, 5 Drawing Sheets

SHAVING SYSTEMS WITH BLADE HOLDER

This invention is concerned with safety razors, and more especially a shaving system of the kind comprising a razor handle for detachably mounting a shaving cartridge, a cartridge adapted for use on the razor handle and a magazine for holding a supply of cartridges for use with the razor handle. The magazine may also be used to receive spent cartridges, the blades of which have become dulled through use, for eventual safe disposal.

In accordance with one aspect the present invention provides a razor handle comprising a mechanism for releasable engagement with a shaving cartridge, said mechanism including a fixed member with engagement means fixed thereon for engagement with a cartridge by movement of the handle relative to the cartridge transversely of the cartridge and substantially parallel to the front face of the cartridge, and a latch for releasable engagement with the cartridge to lock the cartridge against disconnection from the handle during shaving, the latch being movable relative to the fixed member for retraction in a direction generally perpendicular to the front face of a cartridge engaged with the fixed member for releasing the latch from the cartridge to enable the engagement means to be disengaged from the cartridge.

In accordance with another aspect of the present invention there is provided a shaving cartridge comprising a cap, a guard and at least one blade at the front face thereof, the blade being supported by a blade carrier having coupling means for releasable connection to a razor handle, the coupling means including a bearing block at the rear of the cartridge with a longitudinally directed key for engagement in a transverse slot provided on the razor handle, and latching means for cooperation by a latch on the razor handle to prevent disengagement of the key from the slot and detachment of the cartridge from the razor handle.

According to a third aspect the invention provides a magazine for holding at least one shaving cartridge, comprising a container defining two or more discrete compartments for accommodating respective cartridges in a parallel array, the container having side walls forming the ends of the compartments, guide means provided on the side walls and extending between the adjacent compartments for engagement by a razor handle for guiding the razor handle from a shaving cartridge inserted in one compartment to a shaving cartridge inserted in the adjacent compartment, the side walls of the magazine at the opposite ends of a compartment being provided with stop means for engagement with complementary stop means on the razor handle when inserted into the magazine at said compartment thereby to position the razor handle for sliding cooperation with said guide means, and with cartridge releasing means for deactuating cartridge locking means on the razor handle to unlock the handle from a cartridge thereon upon insertion into said magazine compartment to enable the handle to be detached from the unlocked cartridge and moved along the magazine for connection to a cartridge in the next adjacent compartment.

Also in accordance with the present invention there is provided a shaving system comprising a razor handle having engagement means for securing a shaving cartridge releasably to the handle, and a magazine holding at least one shaving cartridge, the magazine comprising two or more discrete compartments for accommodating respective cartridges in a parallel array, and means for co-operation with the engagement means and for guiding movement of the razor handle between the compartments whereby upon insertion of a first cartridge carried by the handle into a vacant compartment the engagement means is operated to allow separation of the handle from the first cartridge, the handle is guided to move towards an adjacent compartment leaving the first cartridge in the previously empty compartment, a second cartridge being accommodated at the adjacent compartment, the engagement means engages said second cartridge as the handle enters said adjacent compartment to secure said second cartridge to the handle, and the handle with the second cartridge secured thereto can then be withdrawn from the magazine.

Furthermore there is provided in accordance with the invention a safety razor comprising a handle having engagement means for releasably connecting the handle to a shaving cartridge, and a shaving cartridge, with at least one blade, having coupling means for cooperation with the engagement means of the handle, wherein the engagement means comprises first means enabling the handle to be moved transversely of the cartridge, in a direction substantially parallel to the front face of the cartridge, for connection to and disconnection from the cartridge, and second means comprising a latch for releasable engagement with the cartridge to lock the cartridge against disconnection from the handle during shaving, the latch being retractable in a direction generally perpendicular to the front face of the cartridge to disengage the cartridge and thereby free the handle for disconnection from the cartridge.

A preferred shaving system described herein embodies the invention in all its aspects. It includes a razor handle, shaving cartridges for use on the handle, and a magazine for holding the cartridges. The handle has a fixed cross member with engagement means comprising pairs of forwardly directed flanges adjacent either end thereof for engaging the cartridge. On the rear of each cartridge are bearing blocks arranged to be received between the respective pairs of flanges on the handle cross member. At least one flange of each pair has a transverse slot into which a key on the corresponding bearing block projects. On its end faces each cartridge has rearwardly directed shoulders and generally V-shaped notches which open at these shoulders and into which latches carried by the handle releasably engage to lock the cartridge to the handle. The latches comprise fingers which cooperate with the notches to define a pivot axis about which the cartridge can pivot relative to the handle. The latches are carried at the respective ends of two arms formed by a rigid yoke member which is guided for forward and rearward movement relative to the fixed cross member of the handle and urged forwardly by a spring conveniently accommodated in a handle portion having a transverse slot through which the yoke member extends. The handle cross member has transverse grooves at its end surfaces for cooperation with guide rails provided in the magazine for guiding the handle along the magazine between the cartridge compartments therein. The ends of the cross mender also have stop elements for cooperation with abutments provided on the magazine side walls at the ends of the compartments for aligning the handle with the guide rails when the handle is introduced into the magazine. Shoulders on the latches cooperate with the guide rails to maintain the latches retracted during movement of the handle along the magazine between cartridge compartments. For initially retracting the latches stops are provided on the side walls of the magazine at the ends of the cartridge compartments, and the latches have projections for engagement with these stops. The stops are provided on resilient tongues and the handle is adapted to cam the tongues at the ends of a compartment to deactuated positions so that the stops thereon are rendered inoperative and the latches can lock onto a cartridge in that compartment when the handle is guided to the compartment along the magazine from the previous compartment at which the handle was introduced. The latch projections and stops can be so positioned that the handle is polarized with respect to the magazine and it is impossible to insert fully into the magazine the handle and a cartridge thereon if their orientations are reversed. The stops on the resilient tongues also serve to block the handle against backward movement along the magazine from one compartment to a previous compartment.

Additional resilient tongues, conveniently formed on partition wall separating the cartridge compartments, are provided on the magazine for snap-engagement with the cartridges for retaining them in the magazine.

With the shaving system according to the invention, replacement of a used shaving cartridge with a fresh cartridge is very simple and convenient to perform. When the used cartridge is inserted into a vacant compartment in the magazine, the handle is automatically guided to pick up a fresh cartridge from the magazine. No additional cartridge disconnection and connection manipulations on the part of the user are needed. Thus, all that is required of the user is to insert the used cartridge into an empty compartment, pull the handle along the magazine to the new cartridge in the next compartment and onto which the handle becomes automatically connected and latched, and to lift the handle and attached cartridge out of the magazine.

Furthermore, a row of cartridges held in the magazine will be dispensed in turn and the user may easily see which cartridge is to be used next and exactly how many unused cartridges remain in the magazine.

A full understanding of the invention and its novel aspects and features will be gained from the following description of an embodiment, given by way of example and with reference to the accompanying drawings, in which.

Figure 2:
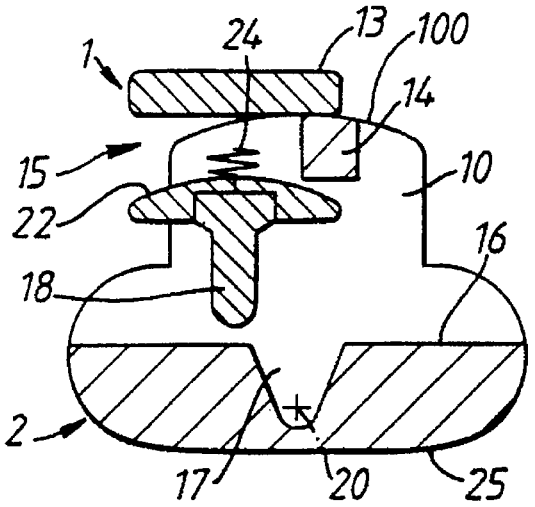
FIG. 2 is a schematic illustration of the connection assembly between the razor handle and the shaving cartridge during an initial stage in the connection of the cartridge to the handle.
Figure 4:
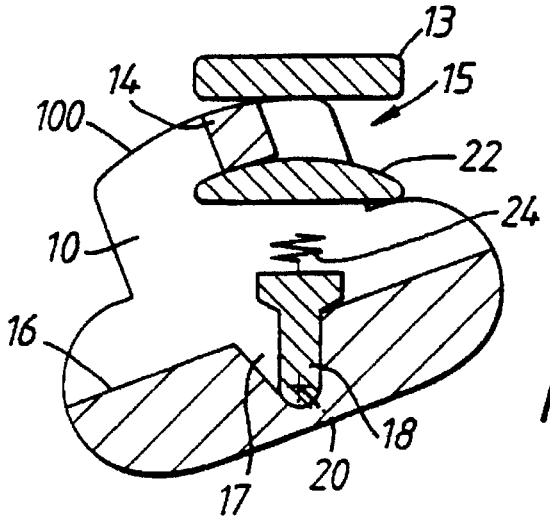
Figure 5:
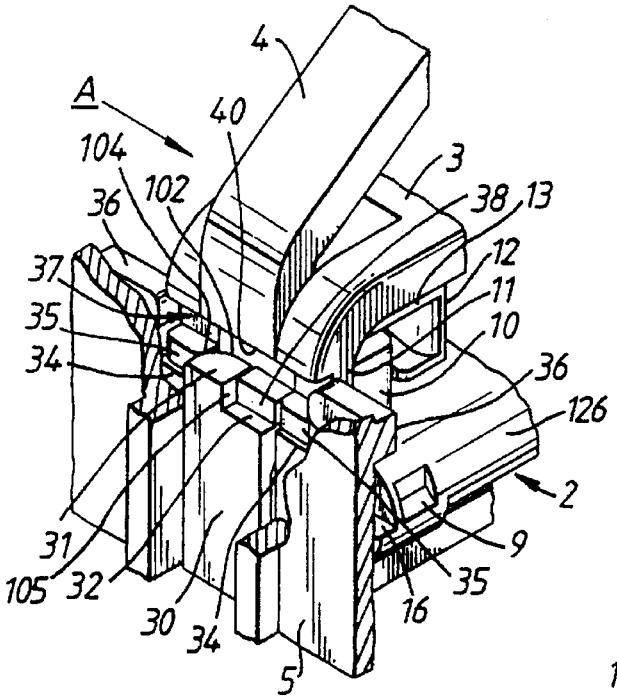
Figure 6:
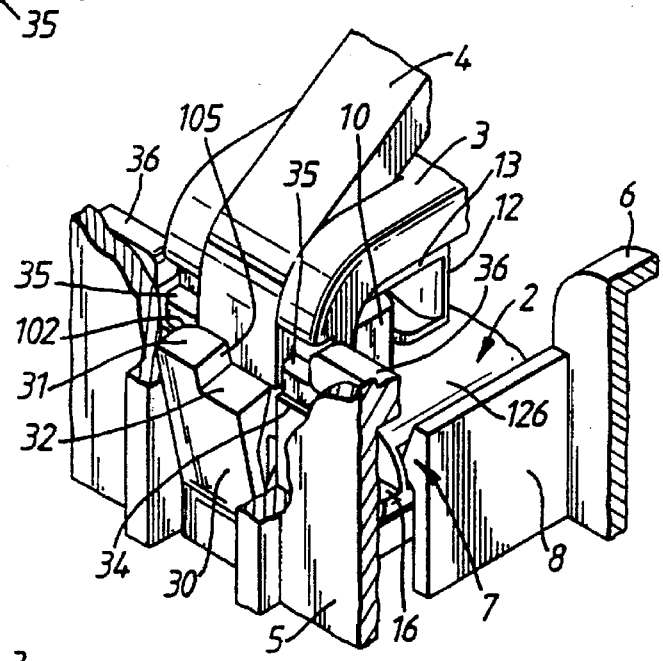
Figure 7:
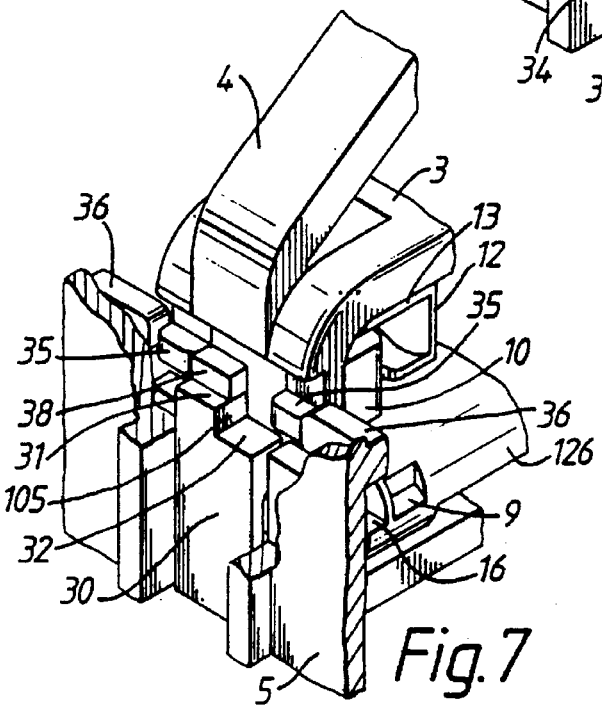
Figure 8:
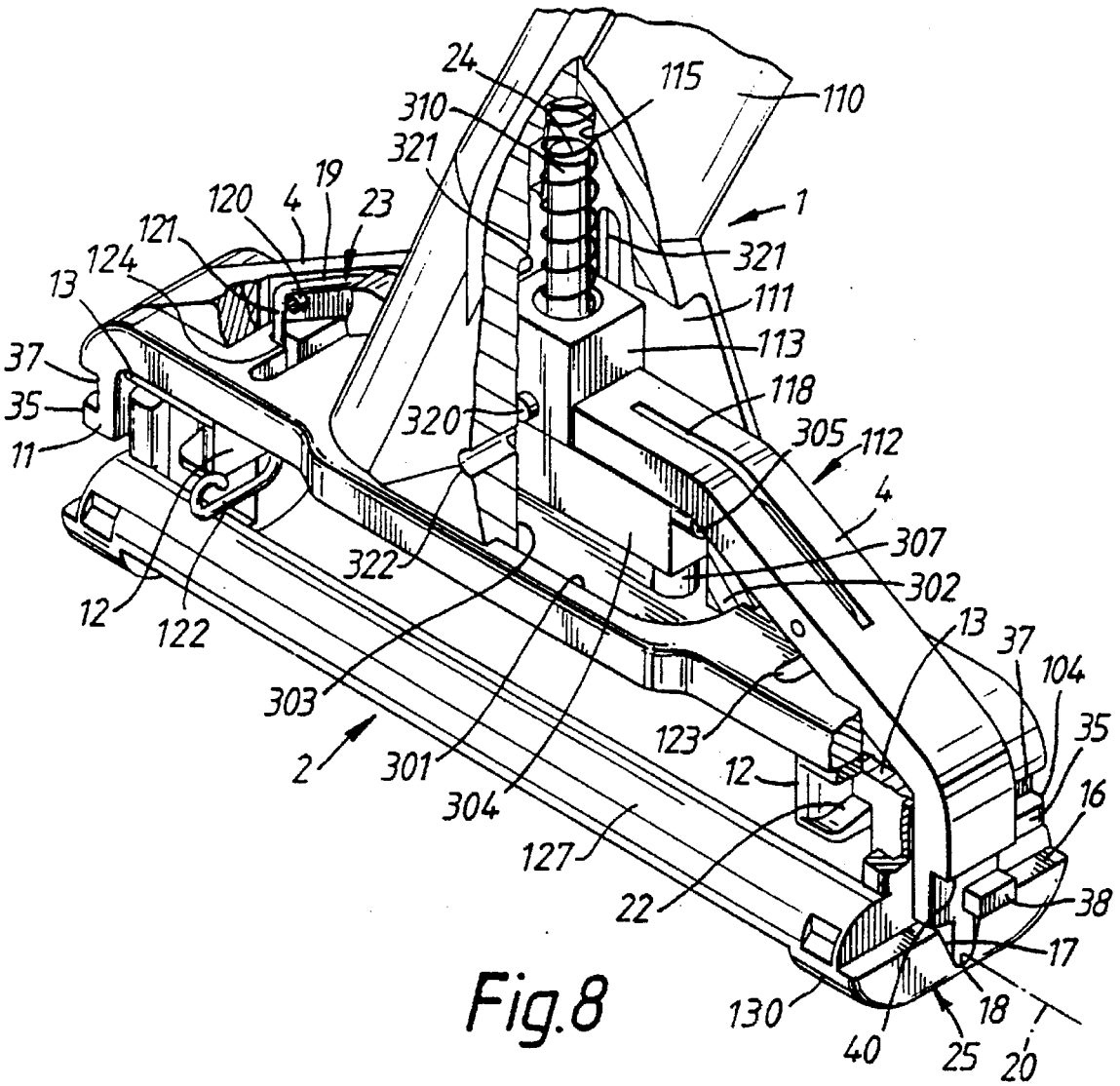
Figure 9:
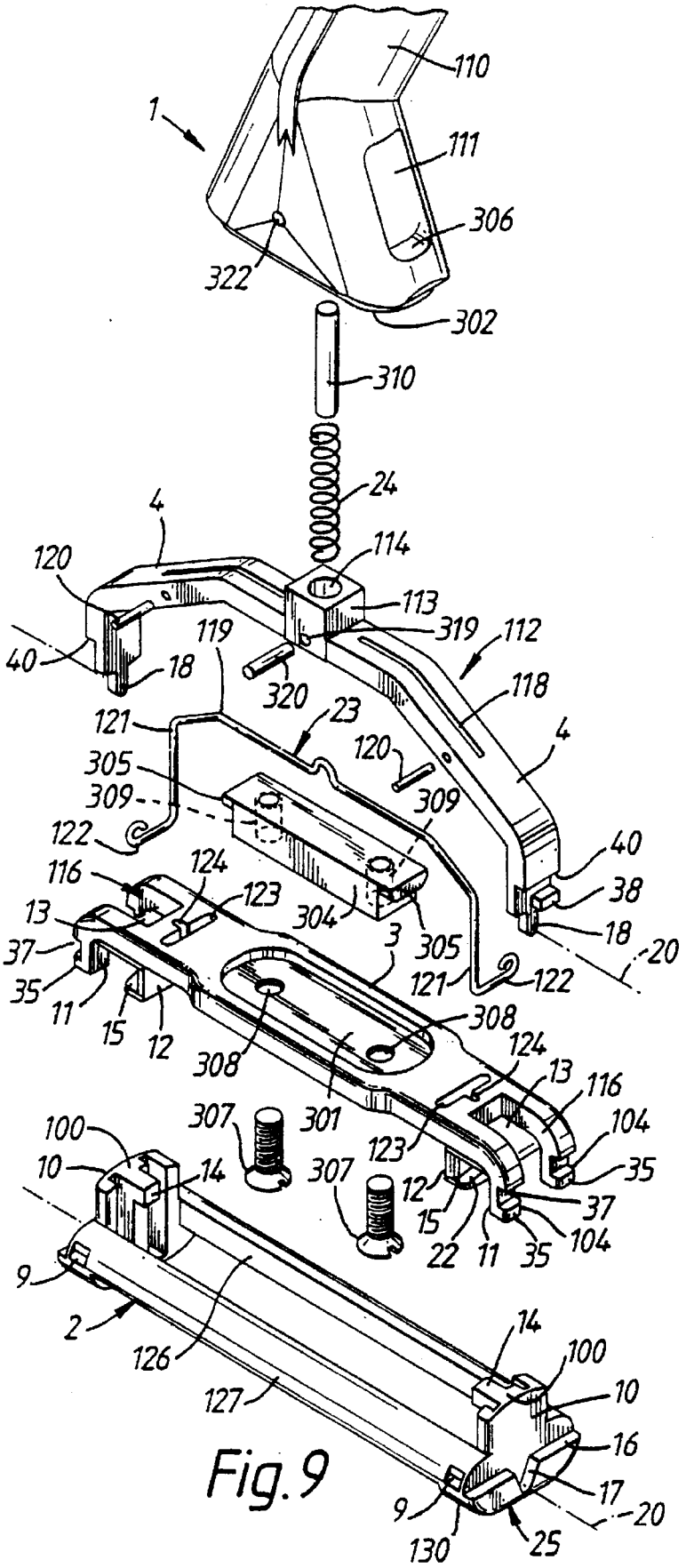

FIG. 4 corresponds to FIG. 2 and shows how the assembly allows pivotal adjustment of the cartridge on the handle;

FIG. 5 is an isometric view in partial cross-section showing the relationship between the handle and magazine on insertion of a cartridge into a vacant cartridge compartment;

FIG. 6 is a view corresponding to FIG. 5 and showing the parts upon movement of the razor handle to collect a cartridge at an adjacent compartment; and FIG. 7 is a view corresponding to FIG. 5 and showing an incorrect positioning of a cartridge into a vacant compartment;

FIG. 8 is a partially cut away enlarged scale perspective view showing the cartridge on the handle and illustrating the addition of a centering spring to bias the cartridge to a central neutral position; and FIG. 9 is an exploded perspective view of the assembly shown in FIG. 8.

Figure 1:
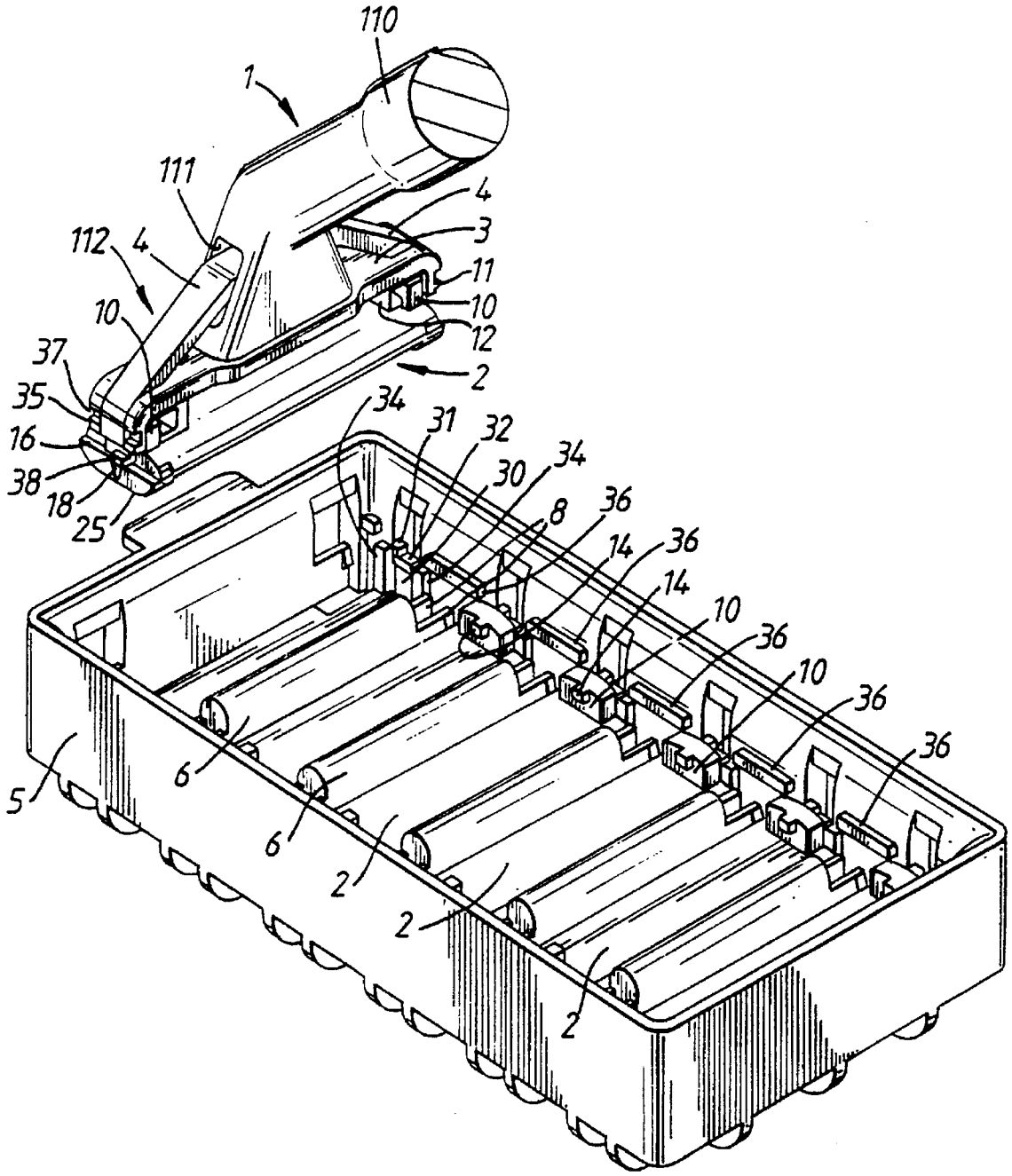
FIG. 1 is a perspective view of a safety razor and cartridge magazine of a shaving system embodying the invention.

The shaving system illustrated in FIG. 1 includes a razor handle 1 fifth a main part 110 (only partly shown) intended to be grasped in the hand of the user, and on which is carried an assembly for detachably mounting a shaving cartridge 2. The shaving system also includes a cartridge magazine 5 for holding for safe storage a plurality of cartridges both before and after use of the individual cartridges on the razor handle 1. As best seen in FIGS. 8 and 9, the handle includes a fixed cross member 3 attached firmly to the end of the main part 110 in a convenient manner. In the illustrated exemplary embodiment the rear surface of the cross member 3 is provided with a non-circular generally rectangular recess 301 and the main part 110 of the handle is formed with an end spigot 302 of complementary configuration adapted to seat in the recess 301. The end portion of the main handle part 11Q is essentially hollow and defines an end opening 303 as well as a laterally directed through hole 111. An anchorage block block 304 is disposed in the opening 303 and is provided at its extreme ends with flanges 305 which sit against rearwardly directed shoulders 306 defined by the openings of hole 111 in order to prevent block 304 passing out through the opening 303. The cross-member 3 is clamped rigidly to the anchorage block 304 and hence the handle part 110 by a Fair of screws 307 which pass through respective holes 308 in the cross member 3 and threadedly engage in tapped holes 309 provided in the anchorage block 304. A yoke member 112 with oppositely directed arms 4 extends through and projects from the hole 111. At its central portion the yoke member 112 includes a spring seat 113 with a recess 114 for receiving one end of a coil spring 24. The other, inner end of the spring is seated in a recess 115 defined within the main handle part 110, and the spring 24 is held in a compressed condition between its two seats so that the yoke member 112 is urged forwardly (downwardly as viewed in FIGS. 8 and 9) against the anchorage block 304 and the cross member 3. The yoke member 112 is able to retract a short distance against the bias of the spring 24 due to the dimensioning of the hole 111 relative to the combined thicknesses of the flanges 115 and the yoke member 112, as may be seen in FIG. 8.

To counteract any tendency for the spring 24 to bend laterally, a rigid rod 310 is inserted loosely within the coils of the spring and extends over a major portion of its length. The central spring seat 113 of the yoke member 112 is guided for rectilinear backwards and forwards movement relative to the main handle part 110 by a pin 320 which passes through a hole 319 in the seat 113 and the opposite ends of which project from the opposite sides of the seat 113 and engage in respective slots 321 defined on the inside surfaces of the cavity defined in the handle main part 110. A hole 322 is provided in the handle part 110 to enable insertion of the pin 320 during assembly of the razor handle 1.

At each end the cross member 3 has an integral forwardly directed flange 11, and an additional flange 12, spaced inwardly from the outer flange 11. The flanges 12 are integral with metal shell bearing element 13 rigidly fastened, such as by adhesive or spot welding to the front face of the cross member 3. Each of the inner flanges 12 is provided with a transverse through slot 15, and the rearwardly directed side wall surface 22 of this slot is curved with a convex form for reasons explained below.

The outer ends of the cross member 3 are provided with slots 116 and the free ends of the yoke arms 4 are slidably guided in these slots. Transverse grooves 37 extend across the outer faces of the flanges 11 immediately behind stop elements 35 defined at the free edges of these flanges. The free end of each yoke arm 4 has an abutment shoulder 40 which can be brought into alignment with the rear side face of the groove 27 when the yoke member is retracted against the action of the spring 24, but is normally spaced forwardly of the groove face, as seen in FIG. 8. A projection 38 forms a stop element on the yoke arm and is spaced from the shoulder 40 at a distance substantially equal to the width of the groove 37. A latch finger 18 with a rounded end projects forwardly from the end of each yoke arm for engagement with the cartridge 2 as described below.

The yoke member 112 carries a bent wire centring spring 23 for biasing a cartridge mounted on the handle to a neutral central pivotal position. The yoke member 112 is provided with a longitudinal slot 118 in which a base limb 119 of the spring is received and retained by the pin 320 and two further pins 120 inserted into holes provided in the respective arms of the yoke member. Forwardly from the ends of the base limb 119 extend spring legs 121, and from the ends of the legs lateral fingers 122 project in opposite directions for bearing on the rear of the cartridge 2 at respective locations on either side of the pivotal axis of the cartridge, as will become clear from the description which follows. The cross member 3 has through slots 123 located inwardly of the flanges 12, and these slots are laterally elongated to enable the spring fingers 122 to be passed through the cross member during assembly of the razor handle. The spring legs 121 are not required to move relative to the cross member 3, and to retain them against such movement central notches 124 are provided to receive the legs 121, as may be clearly seen in FIG. 8.

Each of the cartridges 2 provided for use with the razor handle 1 comprises at least one blade (not shown). As well known in the art a guard and cap are also provided and define surfaces for contacting the skin in front of and behind the blade(s) during shaving. In respect of these features the cartridge may be of known construction. The cartridge conveniently includes a moulded plastics frame 130 supporting the blade(s) etc., and at each end of the cartridge a rearwardly protruding mounting or bearing block 10 is formed integrally with the frame for insertion between a respective pair of flanges 11 and 12 of the cross member of the razor handle. The rear edge faces 100 of the blocks 10 are convexly curved for bearing against the confronting surfaces of the cross member, conveniently provided by the bearing elements 13 as best seen in the schematic illustrations of FIGS. 2 to 4. A longitudinally directed key element 14 is integral with the inner face of each block 10 for engagement in the slot 15 of the adjacent flange 12. At each end face the frame of the cartridge is stepped to define a rearwardly (upwardly as viewed in the drawings) directed shoulder 16, and is formed with a notch 17 opening at this shoulder. The notch 17 is V-shaped with a radiused inner end, and is adapted to receive the latch finger 18 carried at the end of a corresponding yoke arm 4 of the razor handle. The rounded ends of the latch finger 18 and notch 17 cooperate to define an axis 20 about which the cartridge, when connected to the handle, is able to pivot relative to the handle. The frame of the cartridge includes longitudinal members 126,127 located on either side of the pivot axis 20 and respectively positioned behind the guard and cap surfaces of the cartridge. When the cartridge is mounted on the razor handle, the oppositely directed spring fingers 122 rest on the respective longitudinal frame members 126,127 and thereby serve to bias the cartridge to a central pivotal position.

Formed in each frame member 126,127 are a pair of detents 9 for holding the cartridge in the magazine 5 as described below.

Figure 3:
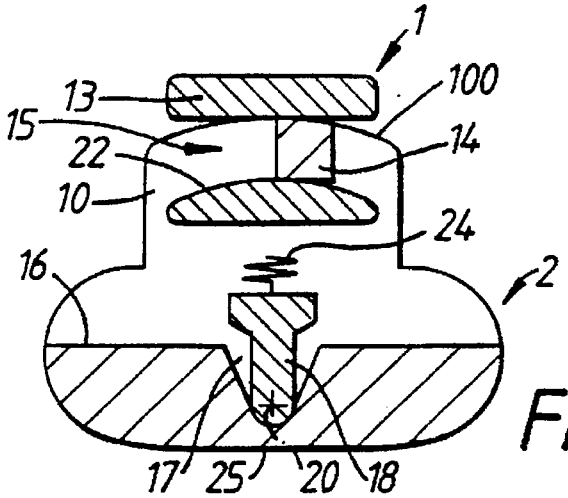
FIG. 3 shows the assembly of FIG. 2 with the cartridge latched onto the handle.

Together the razor handle and cartridge define a novel connection system for pivotally coupling the cartridge to the razor. During assembly of a cartridge with the handle, the yoke member 112 must be retracted against the force of the spring 24 to retract the latch fingers 18. (The spring 24 is depicted only schematically in FIGS. 2 to 4). The handle can then be engaged with the cartridge by moving it transversely of the cartridge and essentially parallel to the front face of the cartridge so that the blocks 10 enter between the pairs of flanges 11,12 and the keys 14 pass into the corresponding slots 15. FIG. 2 shows the latch finger 18 retracted and illustrates the handle during movement into connection with the cartridge. The handle yoke 112 is then released so that the latch fingers 18 are driven forwardly by the expansion of the spring 24 and engage in the notches 17 at each end of the cartridge to lock the cartridge onto the handle (FIG. 3). With the handle and cartridge thus connected, the cartridge is able to pivot about the axis 20, but the maximum angle of pivot is limited to approximately 22.5° to either side of the central position in which the cartridge is illustrated in FIG. 3, by abutment of the latch fingers with the straight inclined sides of the V-notches 17, e.g. as depicted in FIG. 4. As already described above, pivotal displacement away from the central position is resiliently resisted by the spring fingers 122 which act against the longitudinal frame members 126,127. Because the spring 23 is mounted to the yoke member 23 it is withdrawn from the cartridge during the operations of connecting the cartridge to the handle and disconnecting it therefrom. Throughout the range of permitted pivotal movement of the cartridge, each key element 14 remains in contact with the opposed side surfaces of the slot 15 in which it is received, and the curved shape of the rearwardly direct slot surface 22 is intended to ensure sliding contact with the key element 14, while the rear faces 100 of the blocks 10 also maintain contact with the shell bearing surfaces on which they rest. By virtue of this arrangement unwanted backward and forward movements of the cartridge on the handle are precluded. As the surfaces 22 and the surfaces against which the bearing block faces 100 abut are defined by the metal bearing elements 13, those parts of the handle most susceptible to wear over long term use are provided by these small metal components allowing the remainder of the cross member to be made mostly from plastics. Alternatively, the cross member 3 and the elements could be integrally formed, e.g. as a die casting.

Disconnection of the cartridge from the handle is prevented during normal use of the razor. As described in detail below, however, if the latch fingers 18 are once again retracted to disengage the notches 17 at the ends of the cartridge, the keys 14 are free to move out of respective slots 15 for detaching the handle from the cartridge. In the embodiment as illustrated the notch 17 and latch finger 18 define the pivot axis 20 substantially at a midplane of the cartridge. The notch and latch finger could alternatively be arranged to define the pivot axis at any other position, such as adjacent to, in line with, or in front of the blade edges, although the configuration of the key 14 and slot 15 may also need to be changed to suit the pivot axis location.

The cartridge magazine 5, shown complete in FIG. 1, is arranged to operate the latch mechanism of the razor handle during a cartridge changing operation. The magazine. 5 has the form of a rectangular open-topped tray or case divided by lateral partitions 6 to define a series of cartridge compartments for holding respective cartridges 2, with the cartridges being positioned parallel to each other and spaced apart along the magazine. In the embodiment illustrated in FIG. 1 the magazine defines six compartments, the first compartment being shown empty and the remaining five compartments being shown with cartridges accommodated therein. The cartridges are retained in their respective compartments by teeth 7 (see FIG. 6) formed on resilient tongues 8 defined at the opposite ends of the partitions 6, which teeth engage in the complementary detents 9 provided in the cartridges. The cartridges 2 are all of essentially identical construction and are intended to be used in turn on the handle 1 for shaving until the cartridge blades have become dulled. As will become clear from the description which follows, the magazine is so arranged that a used cartridge which is to be replaced on the handle can be inserted into a vacant compartment of the magazine, through the open top of the magazine, and the handle can then be moved along the magazine into correct assembly with a replacement cartridge accommodated in the next adjacent compartment, after which the handle and replacement cartridge may be lifted out of the magazine. The magazine 5 includes inner side walls moulded to provide at either end of each cartridge compartment an upstanding resilient tongue 30, the free upper end of which is stepped to provided upper and lower stops 31,32. Formed on the side wall on either side of the tongue 20 are fixed abutments 34 for co-operation with stop elements 35 fixed on the handle cross member 3 end longitudinal rails 36 extend along the side wall between the cartridge compartments. The rails 36 cooperate with the transverse grooves 37 in the end faces of the handle cross member to guide the razor handle from one cartridge compartment to the next as explained below.

Let it now be assumed that the cartridge shown mounted on the handle in FIG. 1, has been used and is to be replaced by a fresh cartridge from the magazine. By means of the handle, the used cartridge is lowered into the empty first compartment of the magazine. The events which occur at one end of the cartridge will now be elucidated although it should be understood that they will be exactly replicated at the other end of the cartridge where the handle, cartridge and magazine have configurations which mirror those at the first end.

Lowering the cartridge into the magazine brings the projection 38 fixed on the yoke arm 4 against the lower stop 32 of the resilient tongue 30, the off-centre position of the projection 38 ensuring it clears the upper stop 31. Due to the abutment of the projection 38 with the lower step 32, continued lowering of the cartridge results in retraction of the latch finger 18 with respect to the cartridge to disengage the latch finger from notch 17 of the cartridge. This retraction arises as a result of the arm 4 being prevented from continuing its downward movement, and in effect causing the yoke member 112 to be withdrawn against the force of the spring 24 and relative to the cartridge 2 and the handle cross member 3 which move further downwards.

When the cartridge is inserted fully into the empty magazine compartment, the stop elements 35 on the handle cross member 3 are brought into contact with the fixed abutments 34, and the retaining teeth 7 on the tongues 8 (shown in FIG. 6) snap into the detents 9. This is the position shown in FIG. 5, and it can be seen the projection 38 is then raised into alignment with the stop elements 35, and the groove 37 is aligned with the rail 36, so that by pulling the handle along the magazine, the handle can be moved in the direction of arrow A in FIG. 5, forwardly along the magazine and transversely relative to the used cartridge which is prevented from moving with the handle by the partition wall 6 (FIG. 6) separating the cartridge compartments. Backward movement of the handle along the magazine is prevented by abutment of the projection 38 against the vertical surface 105 of the tongue 30 between the faces of stops 31 and 32. However, the forward advancement of the handle is not prevented by the tongue 30 obstructing the trailing stop element 35 as the latter cams the tongue outwardly, due to the rounded surfaces 102,104 on the tongue 30 and stop element 35, so that the stop element 35 slides past the tongue 30. When the stop element 35 clears the tongue 30, i.e. occupies the position in which the projection 38 is shown in FIG. 5, the tongue 30 springs back to its initial position. The handle slides along the rail 36 towards the next adjacent compartment, and during this transfer the yoke arm 4, and hence the latch finger 18, are maintained retracted due to the shoulder 40 on the arm 4 engaging the upper edge of the rail 36.

As the handle approaches the next, i.e. second compartment, having left the used cartridge in the previous compartment, the bearing block 10 and key 14 of the fresh cartridge in the second compartment enter into co-operation with the flanges 11,12 and the slot 15 of the handle as described above and illustrated schematically in FIG. 2 (as seen in this Figure the handle 1 is moving to the right relative to the cartridge 2). In addition, the leading stop element 35 engages the resilient tongue 30 and deflects it outwardly to the position shown in FIG. 6, the rounded edge 104 of the stop element 35 cooperating with the rounded surface 102 on the tongue to effect this camming action. Consequently, as soon as the shoulder 40 clears the rail 36 along which it has slid from the previous magazine compartment, the yoke arm 4 is freed for forward (downward as seen in the drawings) movement under the influence of the yoke spring 24. By this movement the latching finger 18 on the end of the arm 4 is advanced to rest on the shoulder 16 at the end of the cartridge in the second compartment and upon continued movement of the handle into the FIG. 6 position the latching finger is brought into automatic engagement with the notch 17 of the fresh cartridge disposed at the second compartment. Thus, when the handle reaches the position shown in FIG. 6, and depicted schematically in FIG. 3, the handle is latched securely to the new cartridge. The latching of the handle to the cartridge arrests the handle against further movement along the magazine 5, and the handle, with the fresh cartridge connected to it, can only be withdrawn from the magazine. The cartridge is snapped out of engagement with the retaining teeth 7 by pulling lightly on the handle. Of course, this leaves the second compartment of the magazine vacant and when the cartridge removed from this compartment is to be replaced on the handle, e.g. after having become dulled by use, it is re-inserted into the compartment and the handle is moved along to pick up the cartridge in the next adjacent compartment, in exactly the same way as described above. Thus, with the shaving system described the cartridges supplied in the magazine are positively dispensed in turn, i.e. they are picked up by the handle in succession.

With the described shaving system cartridge replacement operations are simple to complete and demand minimal dexterity on the part of the user. In essence a single stroke of the handle relative to the magazine is all that is needed to complete a cartridge replacement operation, albeit that this stroke includes three distinct stages, namely insertion of the used cartridge into the empty compartment of the cartridge, advancement of the handle to the next compartment, and withdrawal of the handle and replacement cartridge from the magazine. When the first two stages have been completed the third stage is the only option available for further movement of the handle relative to the magazine. In addition, once a cartridge has been inserted, unless it is to be withdrawn again, the only possible route for the handle to take is along the magazine to the next cartridge. Consequently, the system is very convenient to the user and there are very limited opportunities for errors to be made when performing a cartridge replacement opera-required to manipulate the handle into correct registration with a new cartridge. Instead the cartridge is connected to and locked onto the handle automatically by smooth sliding motion of the handle along the magazine. As the cartridges do not require any handling while not attached to the handle the system has the additional benefit of ensuring safety to the user during cartridge replacement operations. Advantages of safety are also secured as a result of the cartridges being retained in the magazine, both up to the time of use on the handle, and after such use.

It is to be noted that the stepped configuration on the end of the resilient tongues 30 serves two purposes. Firstly, the vertical shoulder 105 between the two stops 31,32, by engagement with the projection 38, blocks movement of the handle in the wrong direction with respect to the magazine case. Thus, the handle is able to move only in one direction between adjacent cartridge compartments and the handle cannot pick up an already used cartridge in the magazine. The second function is to provide polarisation between the handle and magazine. If attempt is made to insert the handle in a longitudinally reversed position (which would lead to the next cartridge being connected to the handle back to front) the projection 38 meets the upper stop 51 and when the arm 4 is fully retracted, the stop elements 35 are aligned with the rails 36 and prevent movement of the handle to release the connected cartridge and pick up another cartridge. This incorrect inverted or reversed position of the handle and cartridge is illustrated in FIG. 7.

I claim:

1. A shaving system comprising a razor handle (1) comprising connection means (15) supporting a first shaving cartridge (2), said connection means further comprising a latch finger (18) extending perpendicular to a major longitudinal axis of said shaving cartridge and said shaving cartridge further comprising a notch (17) formed in a cartridge frame portion transverse to the cartridge major longitudinal axis and engaging said latch finger (18) securing said cartridge to said razor handle, and a magazine (5) comprising at least two compartments for accommodating respective shaving cartridges (2) in a parallel array extending in the longitudinal direction of said magazine, said magazine holding at least one second said shaving cartridge, wherein said razor handle further comprises at least one outer flange (11) extending in a plane parallel to the transverse cartridge frame portion and comprising leading and trailing stop elements (35) defining a recessed transverse groove (37) on an outer surface of said outer flange (11), said handle further comprising at least one projection (38) proximate said latch finger (18) and extending perpendicular to said latch finger (18) in a direction of said outer flange outer surface, said latch finger (18) and said projection (38) disposed between said leading and trailing stop elements (35) and moveable against a restoring force between a lowered position in which latch finger (18) is biased into engaging said cartridge notch (17) and a raised position in which projection (38) is aligned with said stop elements (35) and latch finger (18) is disengaged from said notch (17), and wherein said magazine further comprises at opposed side walls of said compartments a resilient tongue (30) and fixed abutments (34) on either side of said tongue (30), said tongue (30) having a stop (32) at an upper surface thereof, whereby when said razor handle is introduced into said compartment, said fixed abutments (34) abut respective said handle stop elements (35) and said tongue stop (32) abuts said handle projection (38), said magazine further comprising a longitudinal rail (36) extending between said compartments for sliding cooperation with said handle groove (37), and said tongue (30) being resiliently moveable between a biased first, initial operative position parallel to said side walls and a second, deflected position outward of said initial position, whereby upon insertion of said first cartridge secured to said razor handle into a vacant said first magazine compartment said tongue upper surface (32) raises said projection (38) into alignment with said stop elements (35) and said latch finger (18) is disengaged from said notch (17), thereby releasing said first cartridge from said razor handle, said stop elements (35) contact said fixed abutments (34), and said groove (37) is aligned with said rail (36), then as said trailing stop element (35) deflects said tongue (30) of said first magazine compartment outwardly to said second position, said razor handle groove (37) slides along said rail (36) in said longitudinal direction of said magazine to said second magazine compartment containing a second said shaving cartridge and said leading stop element (35) deflects said resilient tongue (30) of said second magazine compartment outwardly and said latch finger (18) is urged to said lowered position engaging said notch (17) of said second cartridge, thus latching said second cartridge to said razor handle.

2. A shaving system according to claim 1 wherein the razor handle stop elements (35) have cam surfaces and said magazine tongue (30) has complementary cam surfaces for the handle to cam the tongue (30) to the second, deflected position.

3. A shaving system according to claim 1 wherein the tongue (30) further comprises an upper vertical surface (105) adjacent and orthogonal to said tongue stop (32) for abutment by said handle projection (38) if the handle is moved in a direction of the handle trailing stop element (35) along the longitudinal direction along said magazine, thus permitting movement of the handle in the magazine longitudinal direction from said first compartment to the second compartment and to block movement of the handle in the opposite direction.

4. A shaving system according to claim 1 wherein the tongue (30) further comprises an upwardly facing upper stop (31) adjacent said tongue stop (32) and extending a distance upwardly above said tongue stop (32), whereby abutment by said handle projection (38) if said razor handle is introduced in a longitudinally reversed orientation into said compartment causes said handle stop elements (35) to be aligned in confronting relation with edges of said rail (36), thus preventing translational movement of said handle along the magazine longitudinal direction, whereby the handle and said cartridge secured thereto can be inserted fully into a said compartment in a predetermined orientation of the handle relative to the magazine.

* * * * *